United States Patent [19]

Robinson

[11] 4,195,414

[45] Apr. 1, 1980

[54] ELECTRICALLY LIGHTED SIGHT FOR AN ARCHERY BOW

[76] Inventor: Raymond G. Robinson, 114 West Ridge St., Gastonia, N.C. 28052

[21] Appl. No.: 38,405

[22] Filed: May 14, 1979

[51] Int. Cl.[2] ..... F41G 1/32

[52] U.S. Cl. ..... 33/265; 33/241

[58] Field of Search ..... 33/265, 241; 124/87; 362/110

[56] References Cited

U.S. PATENT DOCUMENTS

| | | | |
|---|---|---|---|
| 3,163,938 | 1/1965 | Reynolds | 33/265 |
| 3,667,444 | 6/1972 | Depatie et al. | 33/265 |
| 3,833,799 | 9/1974 | Audet | 33/241 |
| 3,945,127 | 3/1976 | Spencer | 33/265 |
| 4,166,324 | 9/1979 | Carollo et al. | 33/265 |

*Primary Examiner*—William D. Martin, Jr.

*Attorney, Agent, or Firm*—Adams & Jenkins

[57] ABSTRACT

An electrically lighted, vertically and laterally adjustable sight for an archery bow. The sight comprises an elongate battery housing for being mounted lengthwise on an archery bow. A pair of electrically conductive contact strips is carried by the battery housing on a dovetail flange, and at least one sight pin holder is mounted on the dovetail flange for selectively adjustable movement along the longitudinal extent of the contact strips. An elongate sight pin having a light emitter on one end is transversely slidably mounted on the sight pin holder and includes elongate electrical contact strips positioned thereon. A current conductor carried by the sight pin holder operatively interconnects the contact strips on the dovetail flange and on the sight pin.

10 Claims, 11 Drawing Figures

ELECTRICALLY LIGHTED SIGHT FOR AN ARCHERY BOW

BACKGROUND OF THE INVENTION

This invention relates to a sight for an archery bow. The bow sight is characterized by being both vertically and laterally adjustable and includes at least one electrically lighted sight pin for permitting accurate targeting of an arrow in low ambient light conditions, such as in early morning and late evening.

Many archers use sights on their bow to assist in accurately projecting an arrow to its target, especially while hunting. The sight pin is adjusted empirically on a range having known distances. Then, when hunting, the archer estimates the distance to the target and aligns the target with the sight pin. Bow sights are known in the piror art which permit both vertical and lateral adjustment of the sight pin to permit compensating adjustment for distance and windage. For example, the Saunders U.S. Pat. No. 3,590,489 discloses a bow sight having multiple sight pins, each sight pin being independently adjustable for both elevation and lateral deflection corrections. The bow sight according to the Saunders patent incorporates a nonmarring attachment band for permitting quick detachment and reconnection of the sight to the bow.

The Reynolds U.S. Pat. No. 3,163,938 also discloses a bow sight which is both vertically and laterally adjustable. The Reynolds invention includes a numerical range indicator for visually displaying the distance from the archer to a target after the sight has been properly adjusted.

While both of the above-cited patents disclose sights which permit both vertical and lateral adjustment, they do not incorporate means for illuminating the sight for use during low ambient light conditions. Several attempts have been made to correct this problem by providing a sight having lighted sight pins. For example, sight pins of the general type disclosed in the Reynolds U.S. Pat. No. 3,163,938 have been modified by incorporating into one end of the sight pin a small battery casing for enclosing a small watch battery. Devices incorporating this structure have been characterized by high battery consumption, requiring replacement on the order of every 10 to 15 hours. Since one battery is required for each sight pin used, and these watch batteries are relatively expensive, the expense associated with this type of bow sight is relatively high.

The Spencer U.S. Pat. No. 3,945,127 discloses a different method of providing lighted sight pins for use on an archery bow. In Spencer, the principal of fiber optics is employed to carry light from a single light source to a plurality of vertically and laterally adjustable sight pins remote from the light source. While the Spencer sight does eliminate the necessity of using one battery per sight pin, the use of light conducting fibers renders the bow sight very fragile, especially for hunting use in brush or overgrowth, since the light conducting fibers are exposing and are subject to being broken by limbs or twigs into which they may come into contact.

It is therefore an object of this invention to provide an electrically lighted bow sight which eliminates the problems described above. More specifically, it is an object of this invention to provide an electrically lighted, vertically and laterally adjustable sight for an archery bow which is characterized by very low battery consumption. The subject invention provides a structure which is sturdy and not susceptible to damage and permits the use of a plurality of independently adjustable sights, all electrically lighted from a single energy source.

This and other objects and advantages of the present invention are achieved in the preferred embodiment set forth below by providing an electrically lighted, vertically and laterally adjustable sight for an archery bow having an elongate housing containing an electric battery and for being mounted lengthwise on an archery bow in parallel alignment adjacent its hand grip portion. The housing includes a longitudinally extending dovetail flange having a substantially flat, outer free surface with two spaced-apart, longitudinally extending and electrically conductive contact strips being carried on the flange. At least one sight pin holding means is slidably mounted on the dovetail flange for selectively adjustable movement along the longitudinal extend of said housing. The sight pin holding means preferably includes a pair of spaced-apart contacts which matingly engage the spaced-apart, longitudinally extending contact strips carried by the flange. An elongate sight pin is carried by each sight pin holding means for adjustable transverse movement perpendicular to the longitudinal direction of movement of the sight pin holding means. Each sight pin includes a pair of longitudinally positioned spaced-apart contact strips for operative electrical connection with the contacts carried by the sight pin holding means and with a light emitter carried on one end thereof. In this manner, electrical contact between the battery and the light emitter is maintained at all times and at any position of adjustment of either the sight pin holding means or the sight pin itself.

Preferably, the light emitter carried on the sight pin comprises a light emitting diode.

BRIEF DESCRIPTION OF THE DRAWINGS

Some of the objects of the invention having been set forth above, other objects and advantages will appear as the description of the invention proceeds, when taken in conjunction with the following drawings, in which.

DESCRIPTION OF THE PREFERRED EMBODIMENT

Figure 1:
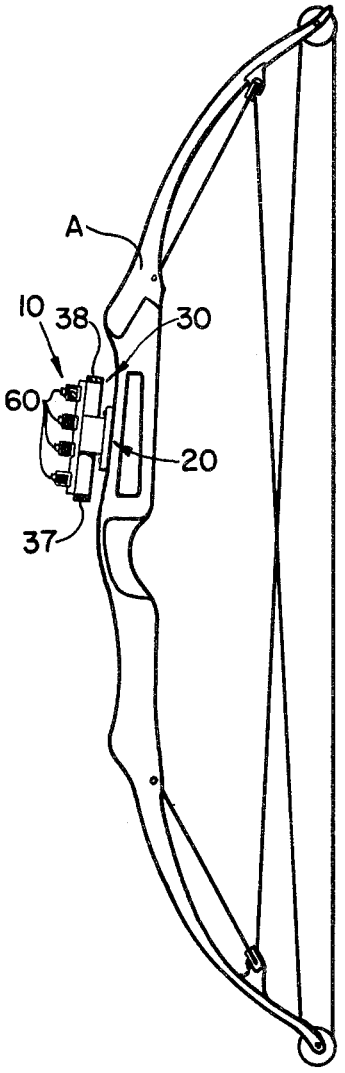
FIG. 1 is a side elevation of the sight mounted on a compound archery bow.
Figure 2:
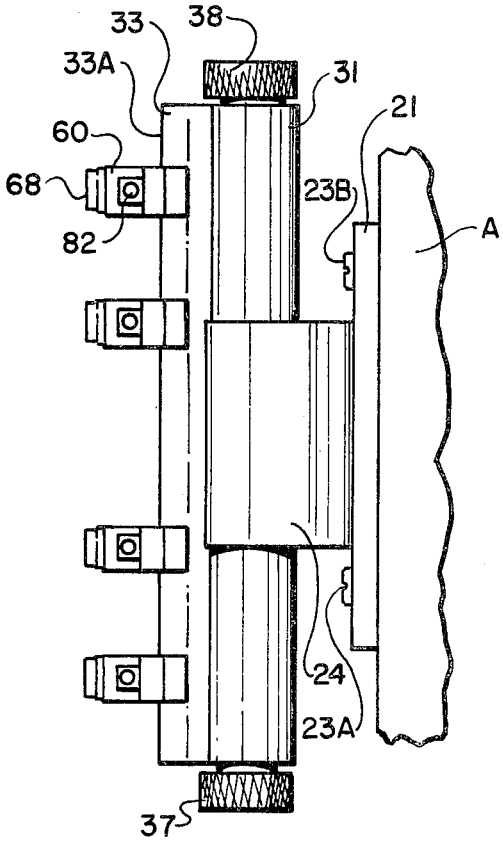
FIG. 2 is an enlarged side elevation of the sight as shown in FIG. 1.
Figure 6:
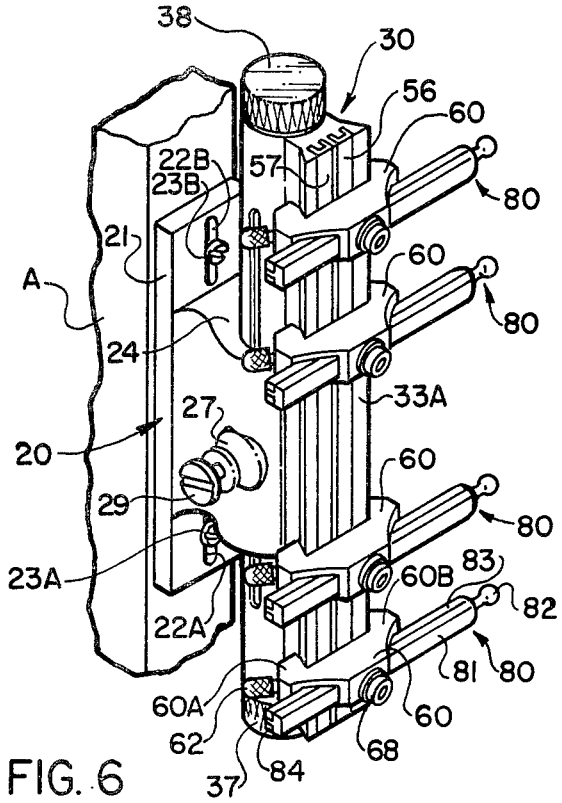
FIG. 6 is a perspective view of the bow sight mounted on a compound bow.

Referring now to the drawings, an electrically lighted, vertically and laterally adjustable sight for an archery bow according to the present invention is shown in FIG. 1 and broadly indicated at 10. This particular disclosure shows the sight mounted on a compound bow "A" in parallel alignment adjacent its hand grip. As is best shown in FIG. 6, the sight 10 is broadly comprised of a mount 20 having an elongate battery housing 30 slidably positioned therein. A plurality of sight pin holding means 60 are slidably positioned on the housing 30 for longitudinal movement thereon. Slidably positioned in each sight pin holding means is an elongate sight pin 80 for transverse movement perpendicular to the longitudinal direction of movement of the sight pin holding means 60.

Figure 5:
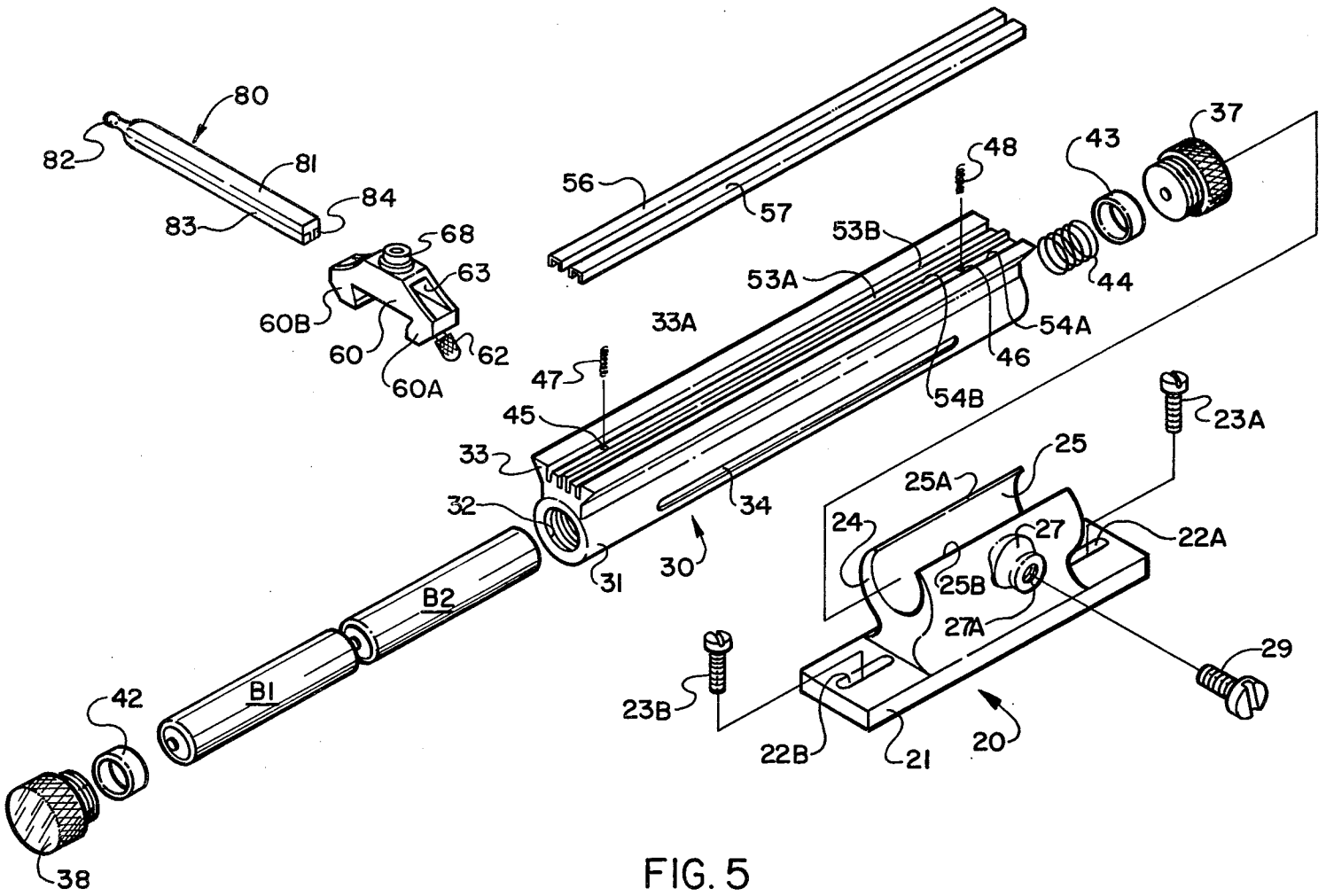
FIG. 5 is an exploded perspective view of the sight.

The bow sight 10 is mounted on the bow "A" by means of the mount 20, preferably formed of injection molded nylon. As is best shown in FIG. 5, the mount 20 includes an elongate mounting plate 21 for being positioned in close surface contact with the forward face of the bow "A" in parallel alignment therewith upwardly adjacent the hand grip of the bow. Screw slots **22*a* and 22*b* are provided on the opposing ends of the mounting plate 21 and communicate therethrough. Mount 21 is attached to the bow by means of screws 23*a* and 23*b* which are matingly received in slots 22*a* and 22*b*** in conventional manner.

Integrally formed on the mounting plate 21 intermediate screw slots **22*a* and 22*b* is a battery housing slide 24. Inner walls 25 of the battery housing slide 24 define a longitudinal, substantially cylindrical void therein for slidably receiving the battery housing 30. As will be observed in FIG. 5, the walls of the battery housing slide 24 define two spaced-apart and opposing free edges 25*a* and 25*b* which define an opening therebetween in substantially diametrical opposition to the mounting plate 21. An integrally formed nylon annular collar 27 having a threaded central bore 27*a* is formed on one side of the battery slide 24 and communicates with the inner walls 25 thereof. A matingly threaded screw 29 is provided for being threadably received in the annular collar 27, and when in use, is inwardly or outwardly adjustable to either prevent or facilitate sliding movement of the battery housing 30**, as will be described in further detail hereinafter.

The battery housing 30 is slidably positioned in the battery housing slide 24. The battery housing 30 is formed of a cylindrical, injection molded nylon body 31 having a central bore 32 therein communicating with the longitudinally opposed ends thereof. Integrally formed on one side of, and longitudinally extending along the length of the nylon body 31 is a dovetail flange 33 having a substantially flat, free outer surface **33*a*. As will be observed in FIG. 3, the lateral thickness of the dovetail flange 33 adjacent the base thereof is very slightly smaller than the distance between the opposing end edges 25*a* and 25*b* of the battery housing slide 24. When the battery housing 30 is thus positioned in the battery housing slide 24, the outer free edges 25*a* and 25*b* thereof slidably impinge upon the opposing sides of the dovetail flange 33 and prevent rotational movement of the battery housing 30 within the battery housing slide 24**.

A longitudinally extending groove 34 is provided in the battery housing 30 for slidable mating engagement with the adjustment screw 29 threadably positioned in the annular collar 27 of the battery housing slide 24. The opposing longitudinal ends of the groove 34 act as stops to prevent the battery housing 30 from sliding out of the battery housing slide 24 when the adjusting screw 29 is only slightly spaced apart from the interior of the groove 34 defined by the outer wall of the battery housing 30.

Figure 9:
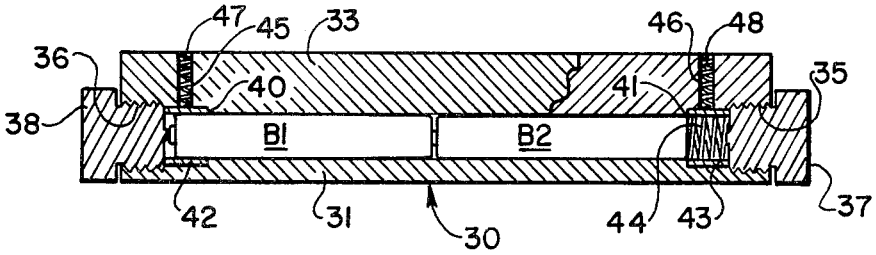
FIG. 9 is a vertical cross-section of ths housing means, showing the internal details of the battery case and dovetail flange.

The bore 32 forms a battery well for receiving two "AAA" size penlite batteries. As is shown in FIG. 9, two such batteries B1, B2, are positioned in the bore 32 of the battery housing 30. The opposing inner walls of the battery housing 30 defining the bore 32 are threaded at their respective ends 35 and 36 to matingly receive brass cap screws 37 and 38. The various functions of the cap screws 37 and 38 are described hereinafter. Formed on the inner walls of the battery housing 30 defining the central bore 32 and adjacent the threaded portions 35 and 36 thereof are shoulders 40 and 41. Positioned on the shoulders and fixedly secured thereto, as by an electrically conductive epoxy glue, are brass rings 42 and 43, respectively. A brass spring 44 is positioned in the bore 32 intermediate the brass cap screw 37 and the negative pole of battery B2. The spring 44 serves to continually urge batteries B1, B2 in the direction of the cap screw 38 and to provide electrical contact between the batteries and the cap screws 37 and 38. Spring holes 45 and 46 are provided in the dovetail flange 33 and communicate with the outer surface of the dovetail flange 33 and the interior of the bore 32 in radial alignment with the shoulders 40 and 41. Brass springs 47 and 48 are positioned in spring holes 45 and 46, respectively, as explained hereinafter.

Formed in the substantially flat free outer surface **33*a* of the dovetail flange 33 are two pairs of parallel, spaced-apart and longitudinally extending grooves 53*a*, 53*b* and 54*a*, 54*b*, respectively, as is shown in FIG. 5. A first electrically conductive contact means, comprising two spaced-apart, brass, "U"-shaped contact strips 56 and 57 are provided to be mounted in parallel alignment on the free, outer surface 33*a* of the dovetail flange 33. The two legs of contact strip 56 are fixedly secured in grooves 53*a*, 53*b*, respectively, by means of electrically conductive epoxy glue—the bridge of the contact strip 56 intermediate its two legs forming an electrically conductive track substantially flush with the flange surface 33*a*. The legs of contact strip 57 are positioned in grooves 54*a*, 54*b*** and secured therein in like manner.

It will be observed that spring holes 45, 46 communicate with the free outer surface **33*a* of dovetail flange 33 intermediate the grooves 53*a*, 53*b*, and 54*a*, 54*b*, respectively. The brass springs 47, 48 in spring holes 45, 46, respectively, are slightly compressed and hence impinge on brass rings 42, 43, respectively, and the underside of the bridge portion of contact strips 56, 57, respectively, and are thus able to conduct electrical current from the batteries B1, B2 to the contact strips 56 and 57**.

In the embodiment of the invention shown in the drawings, contact strip 56 acts as a positive electrical pole, and contact strip 57 as a negative electrical pole due to the position of the batteries with the positive pole of battery B1 engaging cap screw 38, and the negative pole of battery B2 engaging cap screw 37.

Figure 3:
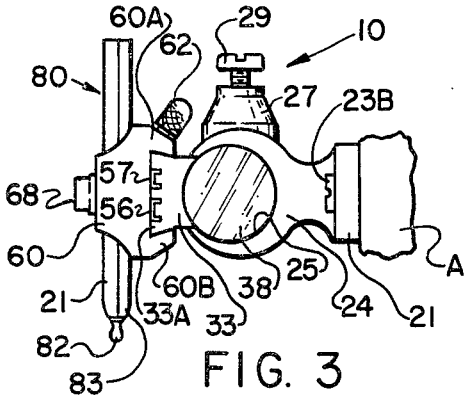
FIG. 3 is a top view of FIG. 2, looking down on the sight from the top of the bow.
Figure 4:
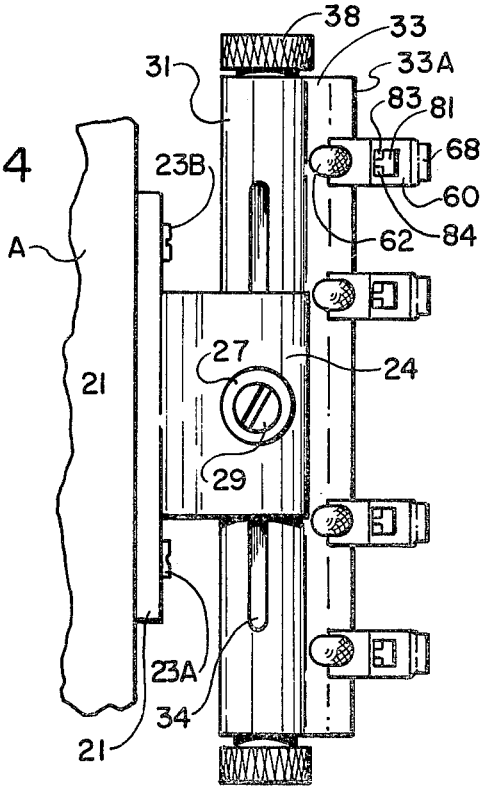
FIG. 4 is a side elevation of the sight taken from the side opposite FIG. 2.

As is best shown in FIGS. 3 and 6, sight pin holding means, comprising a slide 60, is mounted transversely on the dovetail flange 33 and is slidably adjustable along the longitudinal extent of the contact strips 56, 57.

Figure 7:
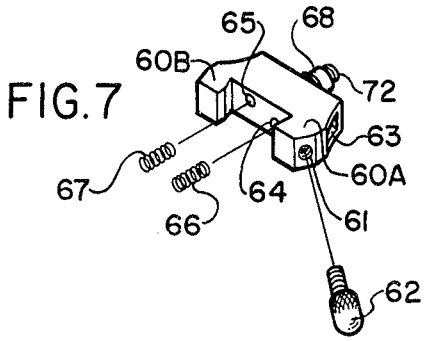
FIG. 7 is an exploded perspective view of the sight pin holding means.

The slide 60 is formed of injection molded nylon and has downwardly extending, inwardly angled legs **60*a*, 60*b* which are matingly received by the dovetail flange 33 to hold to slide 60 in slidable, closely adjacent contact thereto. According to FIG. 7, the walls of leg 60*a* define a threaded hole 61 therethrough which is matingly fitted with a threaded screw 62, having an enlarged knurled head. Hole 61 communicates with the inner wall of leg 60***a* adjacent its juncture with the main body of the slide 60. When slide 60 is mounted on dovetail flange 33, the screw 62 is screwed inwardly through hole 61 and impinges on the underside of the dovetail flange 33 to prevent movement of the slide 60 once the desired adjustment has been determined and made.

Figure 10:
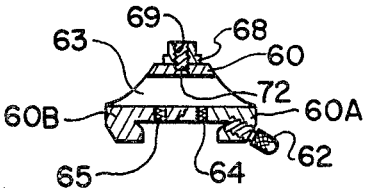
FIG. 10 is a vertical cross-section of the sight pin holding means.

The walls of slide 60 define therethrough a passage 63 which is substantially square in cross-section, as is best shown in FIGS. 5 and 10. Holes 64 and 65 are defined by the medial portion of slide 60 and communicate with passage 63 and the outer wall of slide 60 intermediate legs 60*a*, 60*b*. The holes 64 and 65 are diagonally offset from each other in such manner that when the slide is mounted on dovetail flange 33, hole 64 is positioned directly over contact strip 57 and hole 65 is positioned directly over contact strip 56. Brass springs 66, 67 are compressively positioned in holes 64, 65, respectively, and impinge directly against contact strips 57, 56, respectively.

Figure 8:
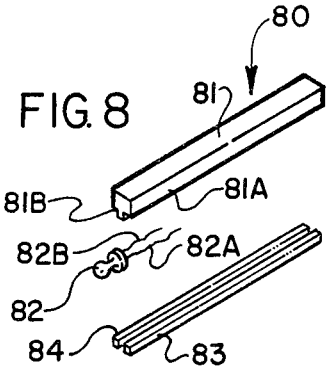
FIG. 8 is an exploded perspective view of a sight pin.
Figure 11:
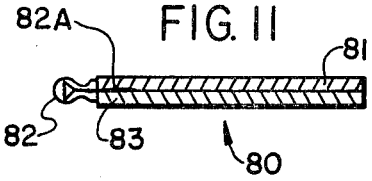
FIG. 11 is a vertical cross-section of the sight pin.

Sight pin means is shown in FIGS. 5 and 11 and comprises an elongate sight pin 80 having a light emitting diode 83 fixedly secured to one end thereof. Sight pin 80 is formed of an injection molded nylon body 81. As is shown in FIG. 8, second electrically conductive contact means, comprising lengths of square brass tubing 83, 84, are received by shoulders 81*a*, 81*b*, respectively of sight pin body 81.

Positive lead 82*a* of light emitting diode 82 is positioned between shoulder 81*a* and the brass tubing 83, and is fixedly secured therebetween by electrically conductive epoxy glue. In like manner, negative lead 82*b* of the light emitting diode 82 is positioned between shoulder 81*b* and brass tubing 84 and is fixedly secured therebetween by electrically conductive epoxy glue.

As is shown in FIG. 5, sight pin 80 is substantially square in cross-section and is matingly received in passage 63 for slidable adjustment therein. When thus positioned in passage 63, brass tubing 83 engages spring 67 and brass tubing 84 engages spring 66, for electrical current flow therethrough to the light emitting diode 82.

As is shown in FIG. 10, a collar 68 is integrally formed on the slide 60 with a threaded bore 69 extending through the collar 68 and the medial portion of the slide 60 in communication with passage 63. A threaded set screw 72 is matingly positioned in bore 69 and is screwed inwardly so as to impinge on the sight pin 80 after the sight pin 80 has been adjusted to its desired position. The set screw 72 may be preferably provided with an integral hex head for turning with a suitably-sized Allen wrench.

In operation, as is shown in FIG. 5, the two "AAA" penlite batteries B1, B2 are loaded into the battery well defined by the internal bore 32. As will be observed in FIG. 9, the opposing ends of the battery well are constructed is essentially the same manner, with the exception of the spring 44 positioned adjacent the cap screw 37. In the configuration shown in FIG. 9, and disclosed in this application, the cap screw 37 acts as a closure for one end of the battery well and as the negative lead from the batteries. Cap screw 38 acts as a battery well closure, an on-off switch and as the positive lead from the batteries. This is accomplished in that when the cap screw 38 is completely screwed into the threads 36 in the bore 32, the outer peripheral axial edge of the cap screw 38 contacts the brass ring 42 and electrical current from the batteries B1, B2 is thus conducted through the cap screw 38, the spring 47, and to the contact strip 56. It should be noted that at all times the cap screw 37 is screwed inwardly to its full extent so that it at all times is in contact with the brass ring 43. Electrical current is thus conducted through the springs 66 and 67 in the slide 60, and through the brass tubing 83 and 84 located on the sight pin body 81. The positive lead 82*a* and negative lead 82*b* of the light emitting diode 82 permit current flow to the light emitting diode 82 thereby illuminating it. In order to switch the light emitting diode 82 off, the cap screw 38 is turned in such manner so as to back it away from contact with the brass ring 42. When the cap screw 38 ceases contact with the brass ring 42, the electrical circuit is broken and the light emitting diode 82 is switched off.

Thus, the bow sight 10 may be used by both left-handed and right-handed archers simply by inverting the bow sight 10 on the bow. Cap screw 38 (the "on-off" switch) will be on the top for left-handed archers and on the bottom for right-handed archers. As described above, it is apparent that the cap screw 37 can become the on-off switch simply by reversing the direction the batteries B1, B2 are placed in the battery well 32, and positioning the brass spring 44 between the cap screw 38 and the negative pole of the adjacent battery.

Also, it will be apparent from the foregoing description that the slide 60 may not be placed on the dovetail flange 33 in reverse position unless either the polarity change described above is effected, or the sight pin 60 is removed and inserted through the passage 63 in the opposite direction so that the proper polarity between the light emitting diode 82 and the batteries is maintained.

Each light emitting diode 82 draws current on the order of 10 milliamps. As a result, a plurality of sight pins 80, each having a light emitting diode 82 thereon, may be used simultaneously and nevertheless create very little battery drain so that at least several hundred hours of use can be obtained from two "AAA" penlite batteries.

It will thus be seen that the subject invention provides an electrically lighted, vertically and laterally adjustable sight for an archery bow. The entire unit is relatively lightweight, sturdy and has relatively few moving parts. The use of light emitting diodes as the light source enables several sight pins to be used simultaneously while nevertheless achieving greatly extended battery life from inexpensive, easy to obtain batteries.

The various details of the above-described bow sight may be changed without departing from the scope of the invention. Furthermore, the foregoing description is for the purpose of illustration only, and not for the purpose of limitation—the invention being defined by the claims.

What is claimed is:

1. An electrically lighted, vertically and laterally adjustable sight for an archery bow, comprising:

a. an elongate housing means for operatively housing an electric battery and for being mounted lengthwise on an archery bow in parallel alignment adjacent the hand grip portion thereof;

b. a first electrically conductive contact means for being longitudinally carried on an outer surface of said housing means along a substantial part of the length thereof and including means for operative electrical connection with the electrical battery;

c. sight pin holding means slidably mounted on said housing means for selectively adjustable movement along the longitudinal extent of said first electrically conductive contact means;

d. elongate sight pin means for being slidably mounted on said sight pin holding means for selectively adjustable transverse movement perpendicular to the longitudinal direction of movement of said sight pin holding means, said sight pin means including a light emitter on one end thereof;

e. a second electrically conductive contact means for being longitudinally positioned on the outer surface of said sight pin means along a substantial part of the length thereof and including means for operative electrical connection with said light emitter; and f. current conducting means carried by said sight pin holding means for operative electrical interconnection of said first and said second electrically conductive contact means;

whereby said sight pin means and said sight pin holding means are slidably adjustable relative to each other and relative to said housing means while electrically interconnected to provide lateral and vertical adjustment of the bow sight.

2. An electrically lighted, vertically and laterally adjustable sight for an archery bow according to claim 1, wherein said first electrically conductive contact means comprises two spaced-apart, longitudinally extending contact strips of opposite polarity.

3. An electrically lighted, vertically and laterally adjustable sight for an archery bow according to claim 2, wherein a longitudinally extending portion of the outer wall of said housing means comprises a longitudinally extending dovetail flange having a substantially flat, outer free surface, said two spaced-apart longitudinally extending contact strips being carried on said flange, and wherein said sight pin holding means includes two spaced-apart, opposing legs for matingly straddling said dovetail flange for movement along the length thereof.

4. An electrically lighted, vertically and laterally adjustable sight for an archery bow according to claim 3, wherein each of said two spaced-apart, longitudinally extending contact strips are U-shaped in cross-section, and wherein said flat surface of said dovetail flange defines two pairs of recessed, longitudinally extending grooves therein for matingly receiving the legs of the U-shaped contact strips.

5. An electrically lighted, vertically and laterally adjustable sight for an archery bow according to claim 4, wherein said sight pin holding means defines a transversely extending void therein for slidably receiving said elongate sight pin means.

6. An electrically lighted, vertically and laterally adjustable sight for an archery bow according to claim 5, and including means for slidably mounting said housing means for longitudinal movement relative to the bow.

7. An electrically lighted, vertically and laterally adjustable sight for an archery bow according to claim 1, wherein said light emitter comprises a light emitting diode.

8. An electrically lighted, vertically and laterally adjustable sight for an archery bow according to claim 7, and including switching means for switching said light emitting diode on and off.

9. An electrically lighted, vertically and laterally adjustable sight for an archery bow according to claim 8, wherein said housing means defines a substantially cylindrical well for receiving at least one battery through an open end thereof, said well having threads formed on the inner wall thereof adjacent to the open end, and wherein said switching means comprises a threaded cap for being threadably received in the open end of said housing means and operatively engaging said battery for selective switching of said light emitting diode on and off as said battery is brought into electrical connection with said first and second contact means in response to the axial movement of said cap along the threads.

10. An electrically lighted, vertically and laterally adjustable sight for an archery bow according to claim 6, and including means for reversably mounting said housing means for use by left-handed and right-handed archers.

* * * * *